US010415945B2

(12) United States Patent
Burky et al.

(10) Patent No.: US 10,415,945 B2
(45) Date of Patent: Sep. 17, 2019

(54) SOLID-STATE OVERVOLTAGE FIRING SWITCH

(71) Applicant: Halliburton Energy Services, Inc., Houston, TX (US)

(72) Inventors: Thomas Earl Burky, Mansfield, TX (US); Thomas Jeffrey Wuensche, Granbury, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 140 days.

(21) Appl. No.: 15/510,267

(22) PCT Filed: Oct. 10, 2014

(86) PCT No.: PCT/US2014/060128

§ 371 (c)(1),
(2) Date: Mar. 10, 2017

(87) PCT Pub. No.: WO2016/057049

PCT Pub. Date: Apr. 14, 2016

(65) Prior Publication Data

US 2018/0231360 A1 Aug. 16, 2018

(51) Int. Cl.

| | |
|---|---|
| ***F42D 1/05*** | (2006.01) |
| ***E21B 43/1185*** | (2006.01) |
| ***F42D 1/04*** | (2006.01) |

(52) U.S. Cl.
CPC ..... *F42D 1/05* (2013.01); *E21B 43/1185* (2013.01); *F42D 1/04* (2013.01)

(58) Field of Classification Search
CPC ... H01T 2/02; F42C 11/00; F42D 1/05; F42D 1/04; F41A 19/58; E21B 43/1185; H01L 33/62; H01L 2933/0016
See application file for complete search history.

(56) References Cited

U.S. PATENT DOCUMENTS

| | | | | |
|---|---|---|---|---|
| 5,216,325 A * | 6/1993 | Patel | ..... | F42C 19/06 313/308 |
| 6,272,955 B1 | 8/2001 | Scemama | | |
| 6,281,567 B1 | 8/2001 | Murayama et al. | | |

(Continued)

OTHER PUBLICATIONS

International Patent Application No. PCT/US2014/060128, International Search Report and Written Opinion dated Jul. 6, 2015, 13 pages.

*Primary Examiner* — Roy K Potter
(74) *Attorney, Agent, or Firm* — Kilpatrick Townsend & Stockton LLP

(57) ABSTRACT

An assembly can include solid-state overvoltage firing switch operable to control an explosive device. The solid-state overvoltage firing switch can include a substrate layer. The solid-state overvoltage firing switch can also include a conductive anode and a conductive cathode positioned on the substrate layer. A gap can physically separate the conductive anode from the conductive cathode. The conductive anode can be operable to receive a voltage from a power source. The solid-state overvoltage firing switch can further include an insulator layer adjacent to the conductive anode and the conductive cathode. At least part of the insulator layer can fill the gap. The insulator layer can cover a first portion of the conductive anode and a second portion of the conductive cathode.

26 Claims, 8 Drawing Sheets

(56) References Cited

U.S. PATENT DOCUMENTS

| | | | | |
|---|---|---|---|---|
| 6,465,793 | B1 * | 10/2002 | Anders | H01J 37/32055 250/298 |
| 7,543,532 | B2 * | 6/2009 | Nance | F42B 3/10 102/202.5 |
| 7,714,240 | B1 | 5/2010 | Roesler et al. | |
| 7,741,156 | B2 | 6/2010 | Pagaila et al. | |
| 7,910,473 | B2 | 3/2011 | Chen | |
| 7,938,707 | B1 | 5/2011 | Walker et al. | |
| 8,091,477 | B2 | 1/2012 | Brooks et al. | |
| 2007/0056462 | A1 | 3/2007 | Bates et al. | |

* cited by examiner

SOLID-STATE OVERVOLTAGE FIRING SWITCH

CROSS-REFERENCE TO RELATED APPLICATIONS

This is a U.S. national phase under 35 U.S.C. 371 of International Patent Application No. PCT/US2014/060128 titled "Solid-State Overvoltage Firing Switch" and filed Oct. 10, 2014, the entirety of which is incorporated herein by reference.

TECHNICAL FIELD

The present disclosure relates generally to solid-state overvoltage firing switches. More specifically, but not by way of limitation, this disclosure relates to a solid-state overvoltage firing switch, such as a firing switch for a perforating gun in a wellbore.

BACKGROUND

A well system (e.g., an oil or gas well) can be drilled for extracting hydrocarbons from a subterranean formation. During the lifecycle of the well system, it can be desirable to pierce a material (e.g., rock, concrete, debris) in the well system, or extract the material from the well system. This can be achieved through the controlled use of explosives. Explosives can be positioned near the material and detonated to pierce the material or remove the material from the well system. A firing switch can be coupled to the explosives and used to detonate the explosives. Firing switches can become unreliable when exposed to high or fluctuating environmental temperatures, pressures, or levels of ambient light.

DETAILED DESCRIPTION

Figure 1:
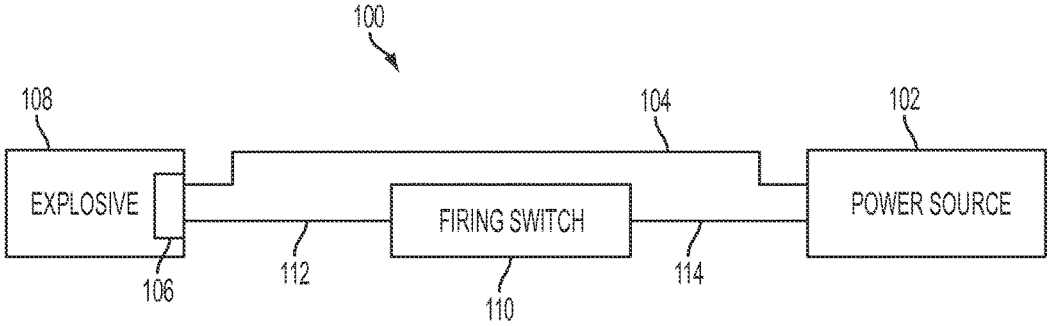
FIG. 1 is a block diagram of a system for using a solid-state overvoltage firing switch according to one example.

Certain aspects and features of the present disclosure are directed to a solid-state overvoltage firing switch. The solid-state overvoltage firing switch ("firing switch") can be used to control an explosive device. For example, the firing switch can be used to detonate an explosive device in a hydrocarbon well system.

The firing switch can include a substrate layer. A conductive anode can be positioned on the substrate layer. A conductive cathode can also be positioned on the substrate layer, such that a gap physically separates the conductive anode from the conductive cathode. An insulator layer can cover a portion of conductive anode and a portion of the conductive cathode. The insulator layer can also fill in the space in the gap. In some examples, the insulator layer can prevent gas, air, or other material from filling the space in the gap. To actuate the firing switch, a voltage over a threshold (i.e., an "overvoltage") can be transmitted to the conductive anode. Because the insulator can be electrically coupled to the conductive anode, the voltage transmitted to the conductive anode can cause the insulator layer to electrically breakdown. This can allow current to flow between the conductive anode and the conductive cathode.

In one example, the firing switch can be coupled to a power source and an explosive device in a wellbore. For example, the firing switch can be coupled to a perforating gun for piercing a cement casing in the wellbore. Upon transmitting an overvoltage from the power source to the conductive anode in the firing switch, the insulator layer in the firing switch can electrically breakdown. This can allow current to flow between the conductive anode and the conductive cathode, which can complete the electrical circuit between the power source and the explosive. With the electrical circuit complete, power can be transmitted to the explosive, which can cause the explosive to detonate.

In some examples, the firing switch can include one or more vias. The vias can be used to electrically couple the conductive anode and the conductive cathode to one or more electrical components (e.g., a printed circuit board). In other examples, the firing switch can be configured to allow the conductive anode and the conductive cathode to directly bond to one or more electrical components (e.g., a wire, resistor, capacitor, or integrated circuit chip). For example, the insulator layer may not cover an entire surface area of the conductive anode. An electrical component can be directly bonded to the exposed portion of the conductive anode via soldering, ultrasonic coupling, welding, soldering, or a conductive epoxy.

The firing switch may include a protective layer. The protective layer can be positioned on the insulator layer. The protective layer can protect the firing switch from damage.

The firing switch may include a reactive layer. The reactive layer can be positioned on the insulator layer. The reactive layer can chemically react with a conductive material in the conductive anode or the conductive cathode upon contact. For example, upon the insulator layer electrically breaking down, the reactive layer can contact the conductive material, initiating the chemical reaction. In some examples, the chemical reaction can generate thermal energy. The thermal energy can detonate an explosive on, near, or surrounding the firing switch.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative examples but, like the illustrative examples, should not be used to limit the present disclosure.

FIG. 1 is a block diagram of a system 100 for using a solid-state overvoltage firing switch 110 according to one example. The system 100 can include a power source 102. The power source 102 can include one or more resistors, capacitors, inductors, integrated circuits, or filtering circuits (e.g., a high-pass filter, low-pass filter, or band-pass filter). The power source 102 can deliver power to a load.

The system 100 can include an explosive material 108 (e.g., an explosive device). In some examples, the system 100 may not include the explosive material 108. For instance, the system 100 can be separate from, but used to control, the explosive material 108.

The system 100 can include an igniter 106. The igniter 106 can be coupled to the explosive material 108 for detonating the explosive material 108. The igniter 106 can detonate the explosive material 108 upon receiving power from the power source 102. For example, the igniter 106 can generate a spark or heat upon receiving power from the power source 102, which can detonate the explosive material 108. In some examples, the system 100 may not include a separate igniter 106. For instance, the igniter 106 can be the explosive material 108 (e.g., the explosive material 108 can detonate upon receiving power directly from the power source 102).

The system 100 can include a firing switch 110 electrically coupled between the power source 102 and the igniter 106. A positive voltage wire 114 can couple the power source 102 to an anode (not shown) of the firing switch 110. Another positive voltage wire 112 can couple a cathode (not shown) of the firing switch 110 to the igniter 106. A negative wire 104 can electrically couple the power source 102 the igniter 106 for completing an electrical circuit between the power source 102 and the igniter 106.

In some examples, the power source 102 can apply an overvoltage to the firing switch 110. This can cause an insulator layer (not shown) positioned between the anode and the cathode in the firing switch 110 can electrically breakdown (as further described with respect to FIGS. 2A and 2B). Upon the insulator layer breaking down, current can flow between the anode and the cathode, which can complete the electrical circuit between the power source 102 and the igniter 106. With the electrical circuit complete, power can flow to the igniter 106, which can cause the explosive material 108 to detonate.

Figure 2A:
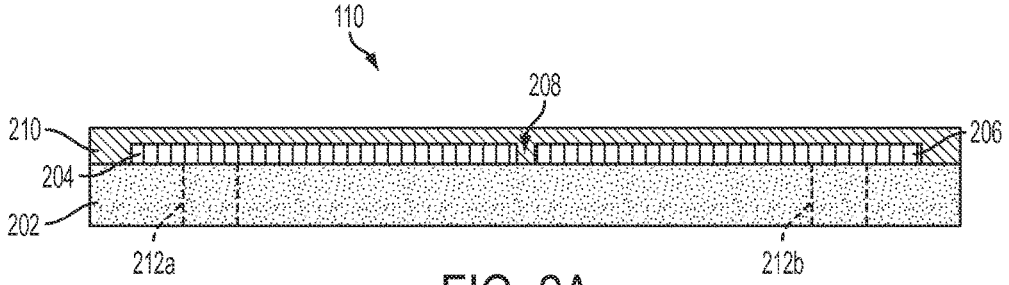
FIG. 2A is a cross-sectional side view of a solid state overvoltage firing according to one example.

FIG. 2A is a cross-sectional side view of a solid-state overvoltage firing switch 110 according to one example. The firing switch 110 can include a substrate layer 202. The substrate layer 202 can include silicon, ceramic, FR-4, glass, epoxy, or fiberglass.

An anode 204 and a cathode 206 can be positioned on the substrate layer 202. The anode 204 and the cathode 206 can be electrically conductive. The anode 204 and the cathode 206 can include any conductive material, such as gold, copper, aluminum, titanium, or zirconium. The anode 204 and the cathode 206 can include the same conductive material or different conductive materials.

Figure 2B:
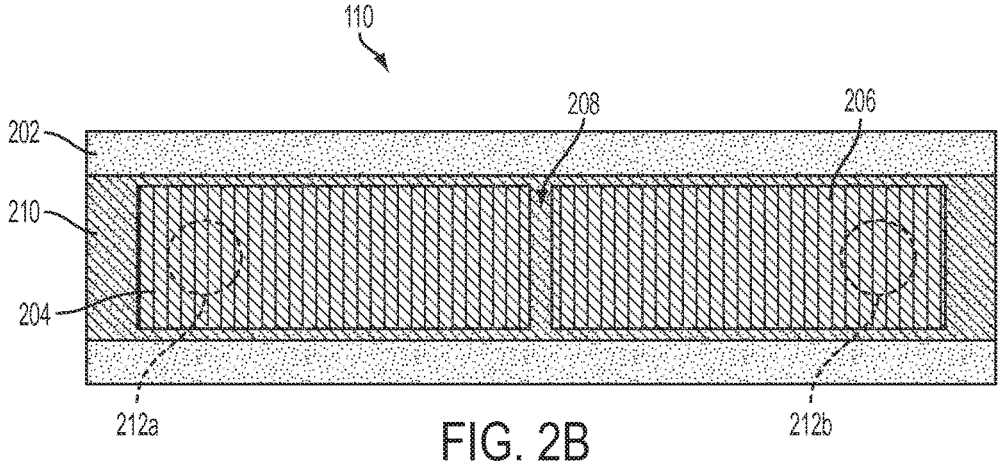
FIG. 2B is a top view of the solid-state overvoltage firing switch shown in FIG. 2A according to one example.

The anode 204 and cathode 206 can be physically separated from one another, creating a gap 208 between the anode 204 and the cathode 206. As shown in FIG. 2B, the gap 208 can entirely separate the anode 204 from the cathode 206. The gap 208 can be linear in shape, for example as shown in FIG. 2B, or can include another shape. For example, the gap 208 can include a "zig-zag" shape. In one such example, the lateral ends of the anode 204 and cathode 206 that are facing the gap 208 can include one or more interwoven protrusions. The interwoven protrusions can generate a zig-zag shaped gap.

The firing switch 110 can include an insulator layer 210. The insulator layer 210 can include a polyimide or glass. In some examples, the insulator layer 210 can completely cover the anode 204, the cathode 206, and the gap 208. In other examples (e.g., as described with respect to FIG. 3A), the insulator layer 210 may not completely cover the anode 204 and the cathode 206. The insulator layer 210 can fill in the gap 208 between the anode 204 and cathode 206, such that there is no air, gas, or other material between the anode 204 and the cathode 206.

In some examples, the firing switch 110 can include vias 212*a-b*. The vias 212*a-b* can be drilled through the substrate 212. The vias 212*a-b* can include any conductive material, such as gold, copper, or aluminum. The via 212*a* can be used to couple the anode 204 to an electrical component (e.g., a wire or printed circuit board). The via 212*b* can be used to couple the cathode 206 to the same electrical component coupled to the anode 204 or to a different electrical component. In some examples, the vias 212*a-b* can be used to surface-mount the firing switch 110 to a printed circuit board.

When voltage less than a threshold is applied to the anode 204, the gap 208 (and the insulator layer 210 within the gap 208) can inhibit electrical communication between the anode 204 and the cathode 206. When an overvoltage is applied to the anode 204, the insulator layer 210 can electrically breakdown. As the insulator layer 210 breaks down, it can change physical state from a solid to a plasma. When in its plasma state, the insulator layer 210 can allow current to flow between the anode 204 and the cathode 206.

The threshold can be determined based on the width of the gap 208 and a material within the insulator layer 210. For example, a wider gap 208 can produce a higher threshold. Conversely, a smaller gap 208 can produce a smaller threshold. As another example, an insulator layer 210 including a material with a lower breakdown voltage can produce a smaller threshold, and an insulator layer 210 including a material with a higher breakdown voltage can produce a larger threshold. In some examples, the material within the insulator layer 210 and the width of the gap 208 can be selected to produce a firing switch 110 that actuates (i.e., allows current to flow between the anode 204 and the cathode 206) when a predetermined voltage is applied to the firing switch 110. For example, the width of the gap 208 and the material within the insulator layer 210 can produce a firing switch 110 that actuates when between 150 V and 250 V is applied to the firing switch 110.

Figure 3A:
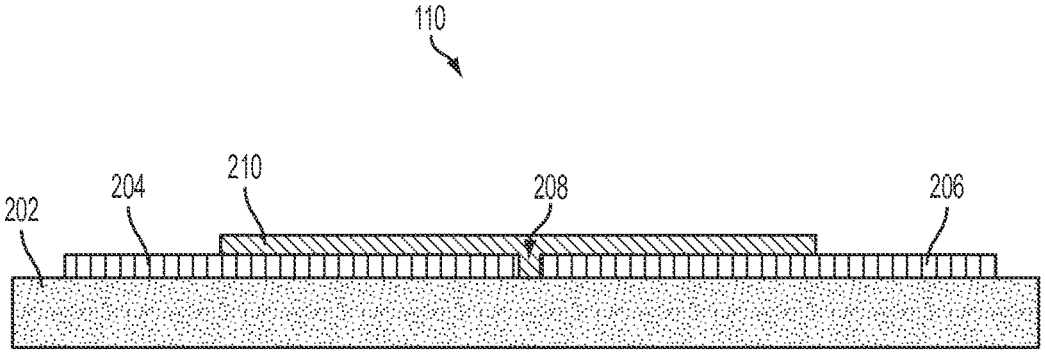
FIG. 3A is a cross-sectional side view of a solid-state overvoltage firing switch according to another example.
Figure 3B:
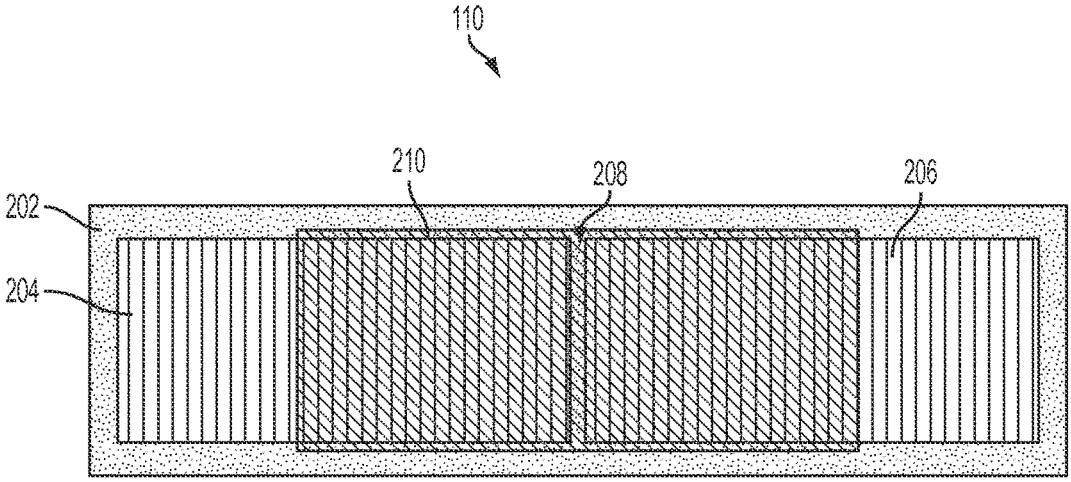
FIG. 3B is a top view of the solid-state overvoltage firing switch shown in FIG. 3A according to one example.

FIG. 3A is a cross-sectional side view of a solid-state overvoltage firing switch 110 to another example. In this example, the insulator layer 210 does not cover the entire surface area of the anode 204 and the cathode 206. This can leave a portion of the anode 204 and the cathode 206 exposed. For example, as depicted in FIG. 3B, the insulator layer 210 can cover the entire height of the anode 204, but may not cover the entire width of the anode 204. This can allow an electrical component to be directly coupled to the exposed portion of the anode 204. Likewise, the insulator layer 210 can cover the entire height of the cathode 206, but may not cover the entire width of the cathode 206 (i.e., the insulator layer 210 may not cover the entire surface area of the cathode 206). This can allow an electrical component to be directly coupled to the exposed portion of the cathode 206. The electrical components can be coupled to the anode 204 and the cathode 206 via any suitable method, such as ultrasonic coupling, welding, soldering, or a conductive epoxy.

In some examples, the firing switch 110 can include vias (not shown) in addition to leaving a portion of the anode 204 and cathode 206 exposed. The vias combined with the exposed portions of the anode 204 and cathode 206 can provide multiple means of coupling the firing switch 110 to an electrical circuit.

Figure 4A:
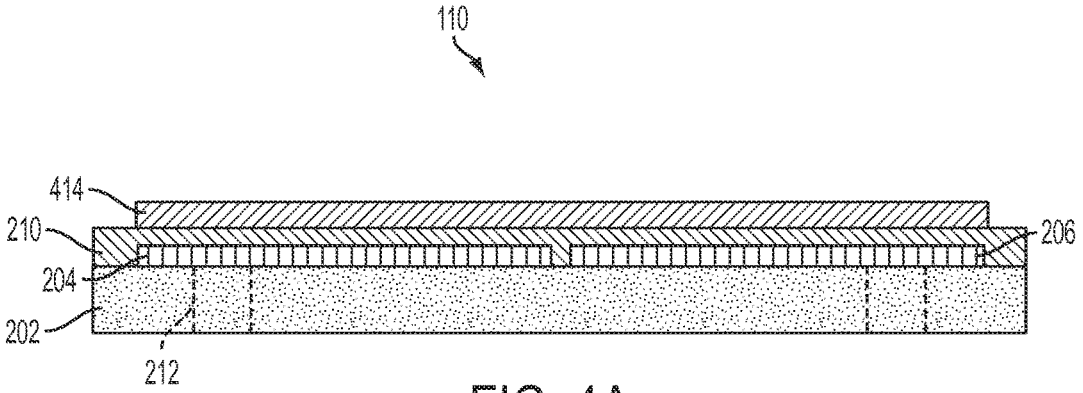
FIG. 4A is a cross-sectional side view of a solid-state overvoltage firing switch according to a further example.

FIG. 4A is a cross-sectional side view of a solid-state overvoltage firing switch 110 according to a further example. The firing switch 110 can include another layer 414 positioned over the insulator layer 210. In some examples, the layer 414 can include a protective material. The protective material can include silicon dioxide, nickel, or glass. The protective material can protect the insulator layer 210 from damage. Damage to the insulator layer 210 can affect the width of the gap between the anode 204 and the cathode 206, the breakdown voltage of the insulator layer 210, or other characteristics of the firing switch 110. This can affect how the firing switch 110 operates. For example, damage to the insulator layer 210 can cause the threshold voltage for actuating the firing switch 110 to change.

Figure 4B:
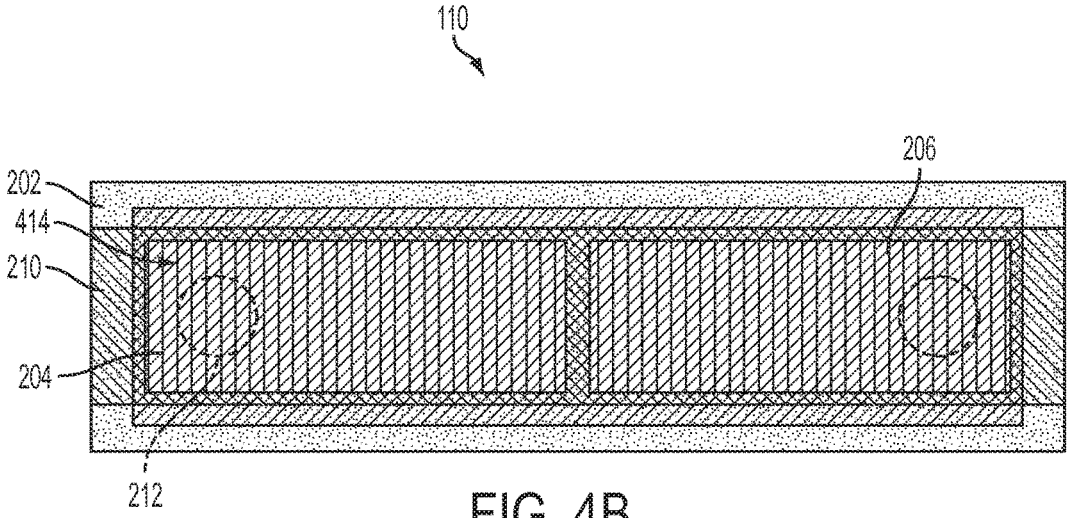
FIG. 4B is a top view of the solid-state overvoltage firing switch shown in FIG. 4A according to one example.

As shown in FIG. 4B, the layer 414 can have a height and width that completely covers the surface area of the firing switch 110 associated with the anode 204 and the cathode 206. This can prevent the anode 204 and the cathode 206 from being damaged.

In some examples, the layer 414 can include a reactive material. The reactive material can include boron or nickel. The reactive material can be chemically react with a conductive material in the anode 204 or the cathode 206. As noted above, when an overvoltage is applied to the anode 204, the insulator layer 210 can breakdown and change its physical state from a solid to a plasma. When in its plasma state, the insulator layer 210 can allow the reactive material to chemically react with the conductive material in the anode 204 or the cathode 206.

Figure 5:
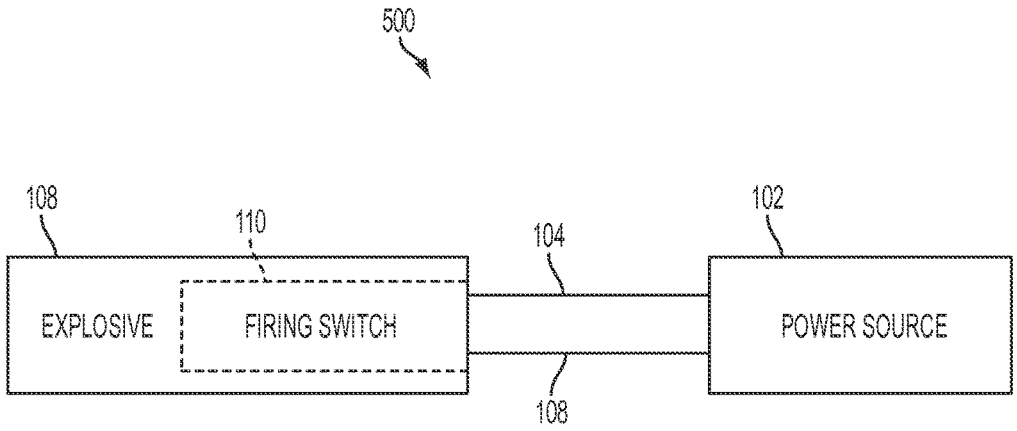
FIG. 5 is a block diagram of a system for using a solid-state overvoltage firing switch according to another example.

In some examples, the chemical reaction between the reactive material and the conductive material in the anode 204 or the cathode 206 can create thermal energy (i.e., heat). The thermal energy can be used to detonate an explosive. For example, as shown in FIG. 5, an explosive material 108 can be thermally coupled to the firing switch 110. The explosive material 108 can be thermally coupled to the firing switch 110 when the explosive material 108 is near, on, or surrounding a portion of the firing switch 110. Upon an overvoltage being supplied by the power source 102 to the firing switch 110, the insulator layer 210 within the firing switch 110 can breakdown. This can allow a chemical reaction to occur between the reactive material and the conductive material within the firing switch 110, which can generate heat. The heat can cause the explosive material 108 to detonate. In such an example, the firing switch 110 can act as both the firing switch 110 and the igniter 106 depicted in FIG. 1. In some examples, the firing switch 110 can be a safer, cheaper, smaller, more reliable, and be easier-to-use alternative to traditional detonation systems.

Figure 6:
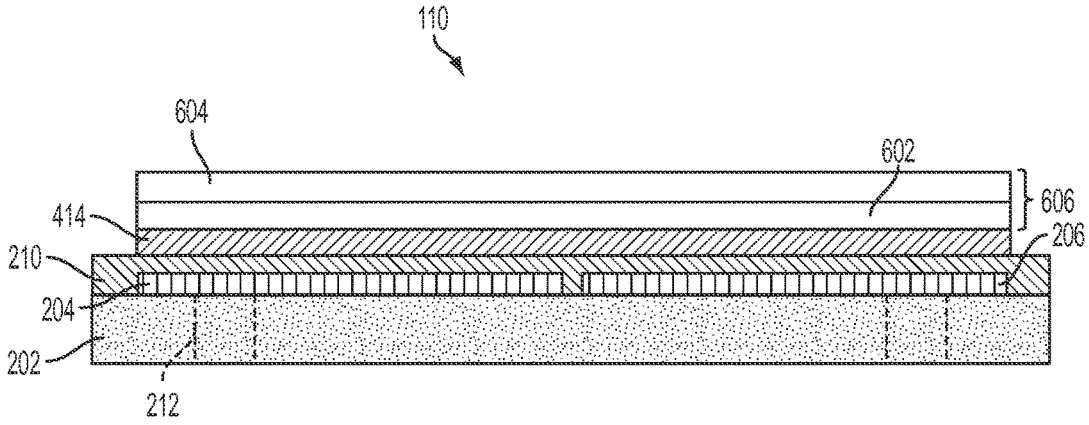
FIG. 6 is a cross-sectional side view of a solid-state overvoltage firing switch that includes an oxidant layer coupled to a reactive layer according to one example.

FIG. 6 is a cross-sectional side view of a solid-state overvoltage firing switch 110 that includes an oxidant layer 602 coupled to a reactive layer 604 according to one example. The oxidant layer 602 can include any oxidizing material. For example, the oxidant layer 602 can include silicon dioxide. The reactive layer 604 can include any reactive material that can chemically react with the oxidant layer 602. For example, the reactive layer 604 can include nickel.

In some examples, upon an overvoltage being supplied by a power source, the insulator layer 210 can breakdown. Once the insulator layer 210 breaks down, a first chemical reaction can occur between the reactive material in the layer 414 and the conductive material in the anode 204 and the cathode 206. The first chemical can cause the firing switch 110 to emit thermal energy. The first chemical reaction can also initiate a second chemical reaction between the oxidant layer 602 and the reactive layer 604. The second chemical reaction can cause the firing switch 110 to emit additional thermal energy.

The combined oxidant layer 602 coupled to the reactive layer 604 can be a reactive set 606. In some examples, multiple reactive sets 606 can be layered or stacked on top of one another. For example, three reactive sets 606 can be layered on top of one another. With more reactive sets 606 chemically reacting, more thermal energy can be produced by the firing switch 110. In some examples, increasing the thermal energy produced from the firing switch 110 can enhance the ability of the firing switch 110 to detonate an explosive.

Figure 7A:
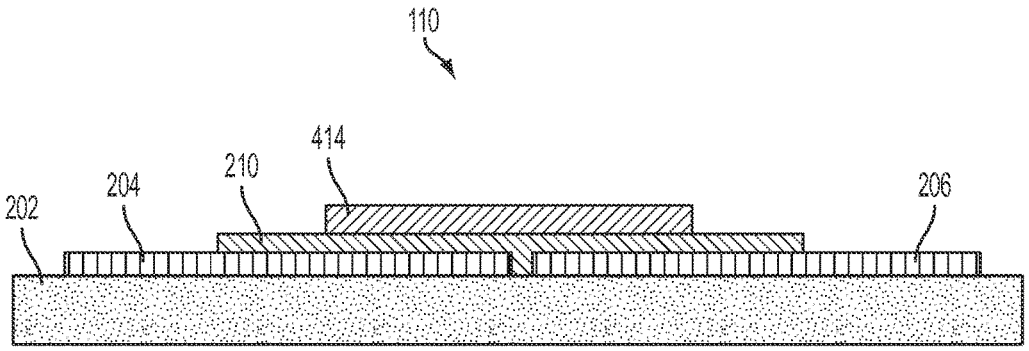
FIG. 7A is a cross-sectional side view of a solid-state overvoltage firing switch according to another example.

FIG. 7A is a cross-sectional side view of a solid-state overvoltage firing switch 110 according to another example. In this example, the insulator layer 210 does not cover the entire surface area of the anode 204 and the cathode 206. This can leave a portion of the anode 204 and the cathode 206 exposed. As described with respect to FIGS. 3A and 3B, electrical components can be directly coupled to the exposed portion of the anode 204 and the exposed portion of the cathode 206.

Figure 7B:
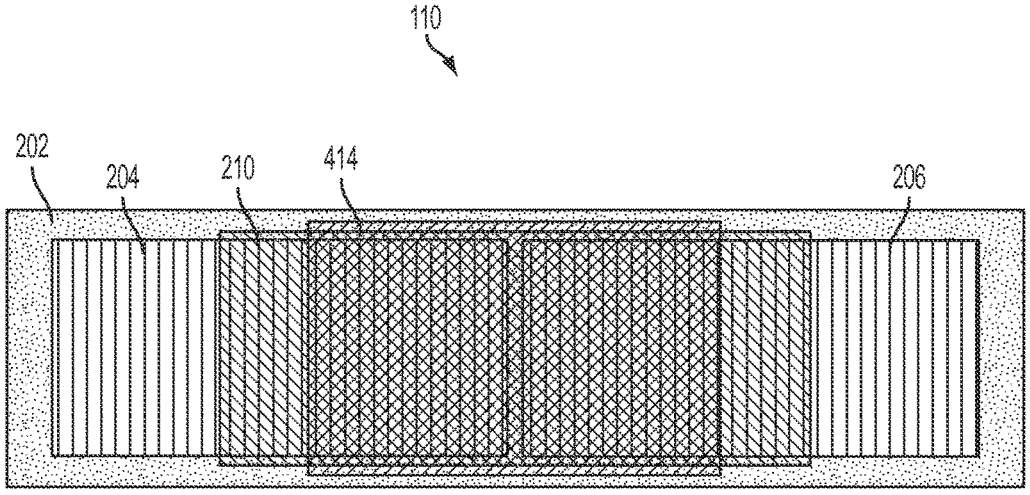
FIG. 7B is a perspective top view of the solid-state overvoltage firing switch shown in FIG. 7A according to one example.

The firing switch 110 can include another layer 414 positioned over the insulator layer 210. The layer 414 can include one or more protective materials or reactive materials. As shown in FIG. 7B, the layer 414 can cover the entire height of the insulator layer 210, but may not cover the entire width of the insulator layer 210 (i.e., the layer 414 may not cover the entire surface area of the insulator layer 210). This can create a distance between the layer 414 and an electrical component that can be coupled to the anode 204 or the cathode 206. The distance can prevent the electrical component from contacting the layer 414, for example, if the electrical component becomes loose or disconnected from the anode 204 or the cathode 206. Contact between the electrical component and the layer 414 can be detrimental to the firing switch 110. For example, if the layer 414 includes a reactive material, such a contact can cause the reactive material to chemically react with the electrical component, which can actuate the firing switch. The distance can also prevent electricity from arcing from the anode 204 to the layer 414.

In some examples, the insulator layer 210 can surround one or more sides of the layer 414. For example, the insulator layer 210 can surround the lateral ends of the layer 414. The insulator layer 210 can act as a barrier to protect the sides of the layer 414 from contacting an electrical component. The barrier can also prevent electricity from arcing from the electrical component to the layer 414.

In some examples, one or more reactive sets (not shown) can be stacked on top of the layer 414. For example, two reactive sets can be layered on top of the layer 414 as described with respect to FIG. 6. The reactive sets can chemically react in response to an overvoltage being applied to the firing switch 110.

Figure 8:
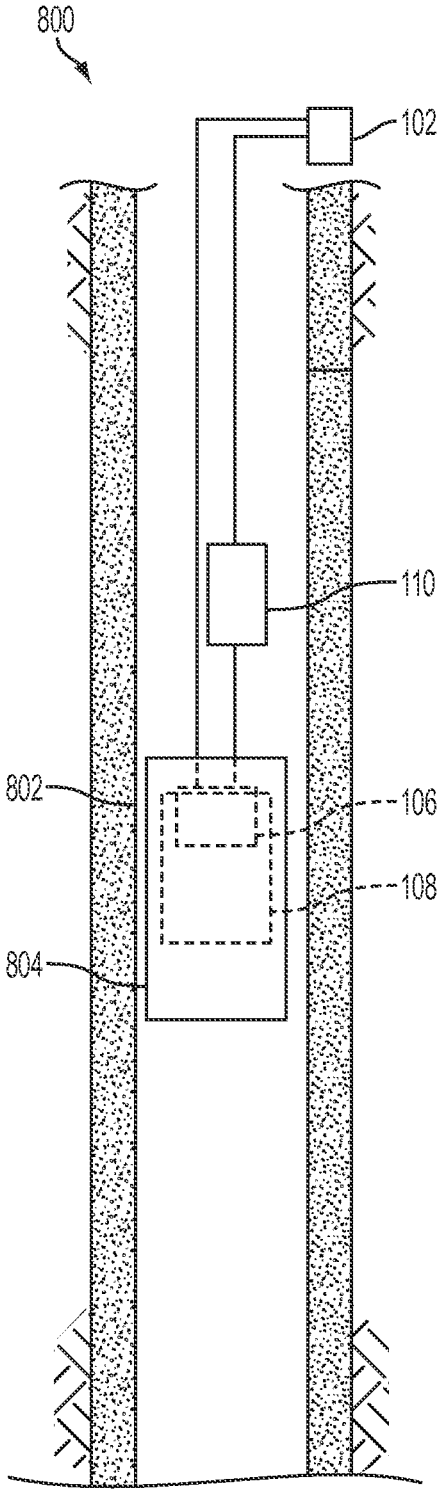
FIG. 8 is a cross-sectional view of a well system that includes a firing assembly with a solid-state overvoltage firing switch according to one example.

FIG. 8 is a cross-sectional view of a well system 800 that includes a firing assembly with a solid-state overvoltage firing switch 110 according to one aspect of the present disclosure. The well system 800 includes a wellbore 802. In some examples, the wellbore 802 can be cased and cemented. In other examples, the wellbore 802 can be uncased or the casing may not be cemented. An annulus can be formed between the well component 804 and a wall of the wellbore 802.

The wellbore 802 can include a well component 804. The well component 804 can include a perforating gun. In some examples, the well component 804 can be suspended in the well by a wireline or a coiled tube (not shown). The well component 804 can include an explosive material 108.

The well system 800 can include a firing assembly. The firing assembly can include an igniter 106 coupled to the explosive material 108. The igniter 106 can detonate the explosive material 108. For example, the igniter 106 can be electrically coupled to a power source 102. Upon receiving power from the power source 102, the igniter 106 can cause the explosive material 108 to detonate.

The firing assembly can include a firing switch 110. The firing switch 110 can be electrically coupled between the power source 102 and the igniter 106. The firing switch 110 can be positioned aboveground, in the wellbore 802, or within a well component (e.g., well component 804). The power source 102 can apply an overvoltage to the firing switch 110. This can cause the firing switch 110 to complete the circuit between the power source 102 and the igniter 106, which can cause the igniter 106 to detonate the explosive material 108.

In some examples, the well system 800 may not include the igniter 106. For example, the power source 102 can be directly coupled to the explosive material 108 and the firing switch 110. The explosive material 108 can detonate upon receiving power from the power source 102. In other examples, the firing switch 110 can be the igniter 106. For example, the firing switch 110 can contact or be positioned near the explosive material 108. Upon actuation of the firing switch 110, a chemical reaction within the firing switch 110 can cause the firing switch 110 to emit thermal energy. The thermal energy can cause the explosive material 108 to detonate.

In some examples, the firing switch 110 can be used outside of a well system. For example, the firing switch 110 can be included in a robot, weapon, vehicle, computing device, or any other suitable system.

Figure 9:
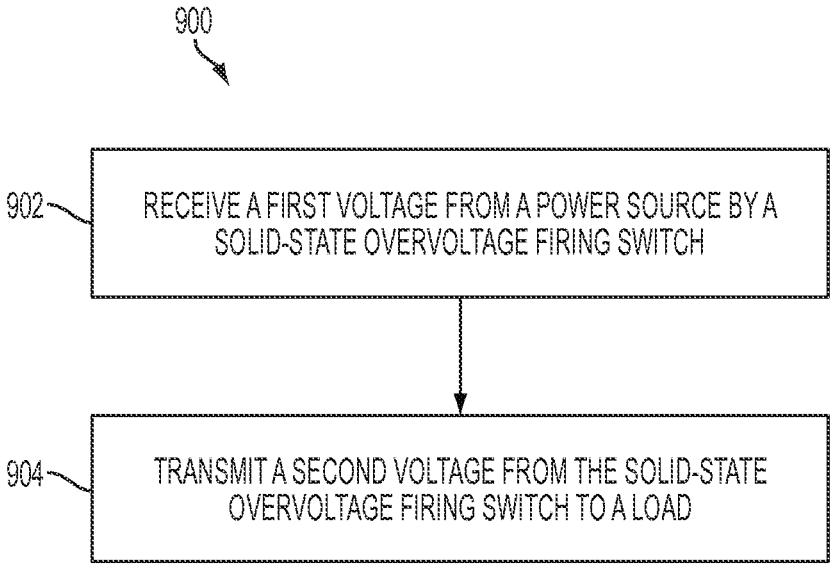
FIG. 9 is an example of a flow chart of a process for using a solid-state overvoltage firing switch.

FIG. 9 is an example of a flow chart of a process for using a solid-state overvoltage firing switch.

In block 902, a solid-state overvoltage firing switch receives voltage from a power source. The solid-state overvoltage firing switch can be electrically coupled to the power source for receiving the voltage. For example, the solid-state overvoltage firing switch can be electrically coupled to the power source by a wire. The voltage can be an overvoltage cause an insulator layer within the firing switch to electrically breakdown.

In some examples, the solid-state overvoltage firing switch can include a conductive anode coupled to a substrate. The solid-state overvoltage firing switch can also include a conductive cathode coupled to the substrate and positioned to generate a gap between the conductive anode and the conductive anode. The solid-state overvoltage firing switch can further include an insulator layer adjacent to the conductive anode and the conductive cathode, at least part of the insulator layer filling the gap.

In block 904, a second voltage is transmitted from the solid-state overvoltage firing switch to a load. The second voltage can be transmitted, for example, by a wire electrically coupling the solid-state overvoltage firing switch to the load.

In some examples, the load can include an explosive device. The explosive device can detonate responsive to the voltage being transmitted from the conductive anode to the conductive cathode.

Figure 10:
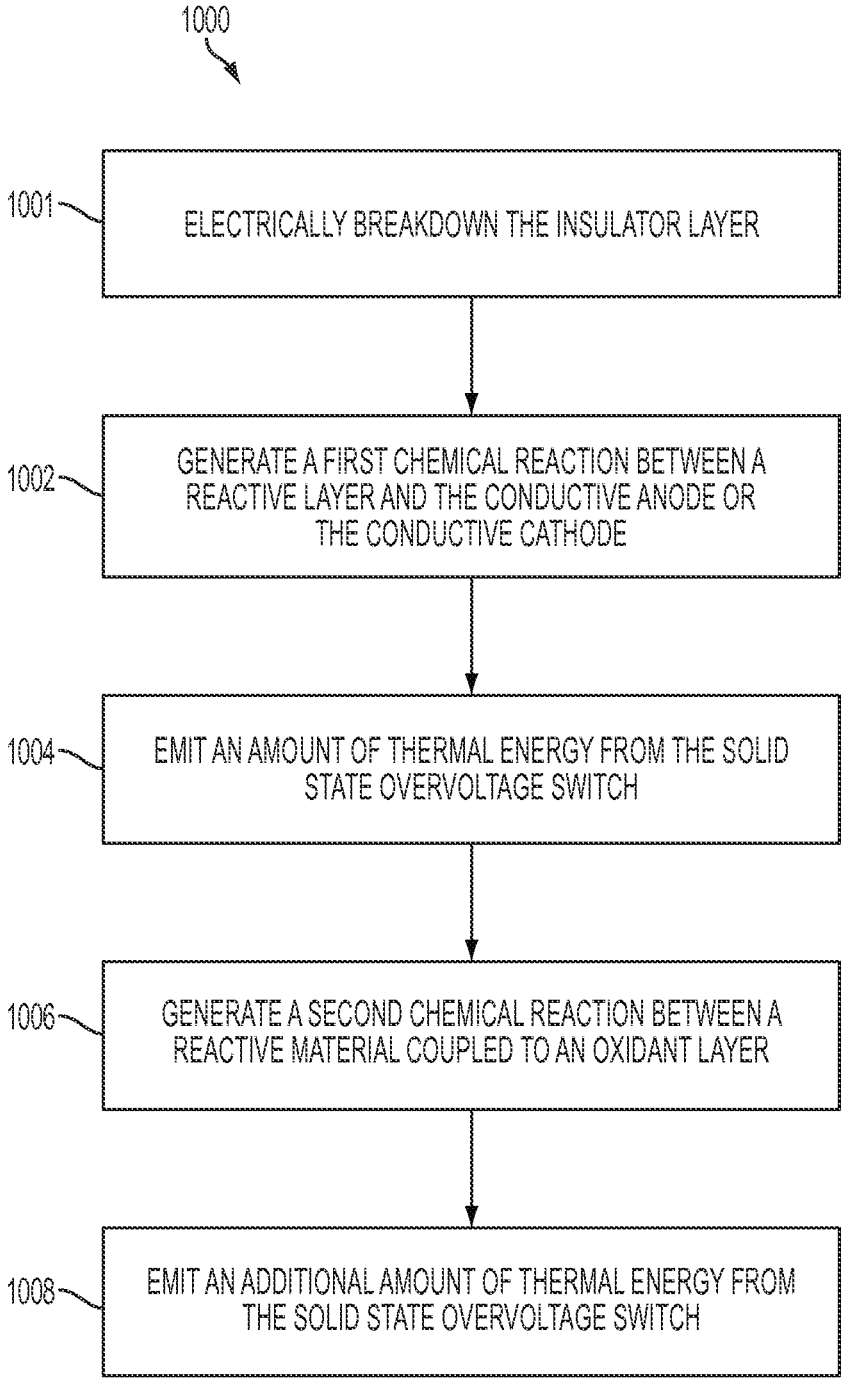
FIG. 10 is an example of a flow chart of another process for using a solid-state overvoltage firing switch.

FIG. 10 is an example of a flow chart of another process for using a solid-state overvoltage firing switch.

In block 1001, an insulator layer electrically breaks down. The insulator layer can electrically breakdown in response to the conductive anode within the solid-state overvoltage firing switch receiving an overvoltage from the power source. For example, the insulator layer can be electrically coupled to the conductive anode. As the voltage is applied to the conductive anode, the voltage can be transmitted to the insulator layer. The voltage can cause electrons within the insulator layer to be released, causing the insulator layer to electrically breakdown. The voltage can also cause the insulator layer to change physical state from a solid to a plasma.

In block 1002, a first chemical reaction occurs between a reactive layer and a conductive anode or a conductive cathode within the firing switch. The first chemical reaction can occur in response to the insulator layer electrically breaking down. For example, upon the insulator layer electrically breaking down, the reactive layer can physically contact the conductive anode or the conductive cathode. Contact between the reactive layer and the conductive anode or the conductive cathode can begin the first chemical reaction.

In block 1004, an amount of thermal energy is emitted from the firing switch. The thermal energy can be emitted as a byproduct or result of the first chemical reaction. For example, the chemical reaction between the reactive layer and the conductive anode or the conductive cathode can generate heat. The heat can be released from the firing switch. The heat can cause an explosive device positioned on, around, or near the firing switch to detonate.

In block 1006, a second chemical reaction occurs between a reactive material coupled to an oxidant layer. The second chemical reaction can occur in response to the first chemical reaction. For example, as heat is emitted from the solid-state overvoltage firing switch due to the first chemical reaction, the heat can cause the second chemical reaction to occur.

In block 1008, an additional amount of thermal energy is emitted from the firing switch. The thermal energy can be emitted as a byproduct or result of the second chemical reaction. For example, the chemical reaction between the reactive material and the oxidant layer can generate heat. The heat can be released from the firing switch. The heat can cause an explosive device positioned on, around, or near the firing switch to detonate.

In some aspects, a system for a solid-state overvoltage firing switch is provided according to one or more of the following examples:

Example #1

An assembly can include a solid-state overvoltage firing switch operable to control an explosive device. The solid-state overvoltage firing switch can include a substrate layer. The solid-state overvoltage firing switch can also include a conductive anode and a conductive cathode. The conductive anode and the conductive cathode can be positioned on the substrate layer. A gap can physically separate the conductive anode from the conductive cathode. The conductive anode can be operable to receive a voltage from a power source. The solid-state overvoltage firing switch can further include an insulator layer adjacent to the conductive anode and the conductive cathode. At least part of the insulator layer can fill the gap. The insulator layer can be operable to cover a first portion of the conductive anode and a second portion of the conductive cathode.

Example #2

The assembly of Example #1 may feature the voltage being above a threshold operable to cause the insulator layer to electrically breakdown and allow a current to flow between the conductive anode and the conductive cathode.

Example #3

The assembly of Example #2 may feature current being operable to detonate the explosive device. The explosive device can be positioned in a wellbore.

Example #4

The assembly of any of Examples #2-3 may feature a reactive layer coupled to the insulator layer. The reactive layer can include nickel or boron. The reactive layer can be operable to chemically react with the conductive anode or the conductive cathode to generate an amount of thermal energy.

Example #5

The assembly of Example #4 may feature the amount of thermal energy being for detonating the explosive device. The explosive device can surround a portion of the solid-state overvoltage firing switch.

Example #6

The assembly of any of Examples #4-5 may feature multiple reactive sets. Each reactive set can include an oxidant material coupled to a reactive material. The multiple reactive sets can be operable to generate another amount of thermal energy responsive to the reactive layer chemically reacting with the conductive anode or the conductive cathode.

Example #7

The assembly of any of Examples #4-6 may feature a part of the insulator layer being uncovered by the reactive layer.

Example #8

The assembly of any of Examples #1-7 may feature the explosive device being a perforating gun usable in a wellbore.

Example #9

The assembly of any of Examples #1-3 and 8 may feature a protective layer directly covering the insulator layer. The protective layer can include silicon dioxide, nickel, or glass. The protective layer can be operable to protect the solid-state overvoltage firing switch from damage.

Example #10

The assembly of Example #9 may feature a part of the insulator layer being uncovered by the protective layer.

Example #11

The assembly of any of Examples #1-10 may feature a first via extending through the substrate layer and coupled to the conductive anode. The assembly may also feature a second via extending through the substrate layer and coupled to the conductive cathode. The first via and the second via can include gold, copper, or aluminum. The first via and the second via can be operable to electrically couple the solid-state overvoltage firing switch to a printed circuit board.

Example #12

The assembly of any of Examples #1-11 may feature a first part of the conductive anode being uncovered by the insulator layer and a second part of the conductive cathode being uncovered by the insulator layer. The first part can be coupled to a wire in an electrical circuit and the second part can be coupled to another wire in the electrical circuit.

Example #13

A method can include receiving a first voltage from a power source by a solid-state overvoltage firing switch. The solid-state overvoltage firing switch can include a conductive anode coupled to a substrate. The conductive cathode can be coupled to the substrate and positioned to generate a gap between the conductive anode and the conductive anode. The solid-state overvoltage firing switch can also include an insulator layer positioned adjacent to the conductive anode and the conductive cathode. At least part of the insulator layer can fill the gap. The method can also include, responsive to the first voltage exceeding a threshold, transmitting a second voltage from the solid-state overvoltage firing switch to an explosive device Example #14

The method of Example #13 may feature the solid-state overvoltage firing switch being in a well system and controlling the explosive device.

Example #15

The method of any of Examples #13-14 may feature electrically breaking down the insulator layer responsive to receiving the first voltage. The assembly may also feature generating a first chemical reaction between a reactive layer and the conductive anode or the conductive cathode responsive to the insulator layer electrically breaking down. The method may further feature emitting an amount of thermal energy from the solid-state overvoltage firing switch responsive to generating the first chemical reaction.

Example #16

The method of any of Examples #15 may feature, responsive to generating the first chemical reaction, generating a second chemical reaction between a reactive material coupled to an oxidant layer positioned on the reactive layer. The method may also feature responsive to generating the second chemical reaction, emitting an additional amount of thermal energy from the solid-state overvoltage firing switch, wherein the additional amount of thermal energy causes the explosive device to detonate.

Example #17

A system can include a solid-state overvoltage firing switch operable to control an explosive device. The solid-state overvoltage firing switch can include a substrate layer, a conductive anode and a conductive cathode positioned on the substrate layer, and a gap physically separating the conductive anode from the conductive cathode. The solid-state overvoltage firing switch can also include an insulator layer adjacent to the conductive anode, the conductive cathode, and the gap. At least part of the insulator layer can fill the gap. The system can also include the explosive device. The explosive device can be electrically coupled or thermally coupled to the solid-state overvoltage firing switch and can be positionable in a wellbore. The system can further include a power source electrically coupled to the explosive device and the solid-state overvoltage firing switch. The power source can be operable to transmit a voltage to the conductive anode.

Example #18

The system of Example #17 may feature the solid-state overvoltage firing switch further including a reactive layer coupled to the insulator layer. The reactive layer can include nickel or boron. The reactive layer can be operable to chemically react with the conductive anode or the conductive cathode to generate an amount of thermal energy.

Example #19

The system of Example #18 may feature the amount of thermal energy being for detonating the explosive device.

Example #20

The system of any of Examples #17-19 may feature the explosive device being included in a perforating gun usable in the wellbore.

The foregoing description of certain embodiments, including illustrated embodiments, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly comprising:

a solid-state overvoltage firing switch operable to control an explosive device, the solid-state overvoltage firing switch comprising:

a substrate layer;

a conductive anode and a conductive cathode, the conductive anode and the conductive cathode being positioned on the substrate layer, wherein a gap physically separates the conductive anode from the conductive cathode, wherein the conductive anode is operable to receive a voltage from a power source;

an insulator layer adjacent to the conductive anode and the conductive cathode, at least part of the insulator layer filling the gap, wherein the insulator layer is operable to cover a first portion of the conductive anode and a second portion of the conductive cathode; and a reactive layer coupled to the insulator layer, wherein the reactive layer is operable to chemically react with the conductive anode or the conductive cathode to generate thermal energy.

2. The assembly of claim 1, wherein the insulator layer is configured to electrically breakdown and allow a current to flow between the conductive anode and the conductive cathode when the voltage exceeds a threshold.

3. The assembly of claim 2, wherein the current is operable to detonate the explosive device, and wherein the explosive device is positioned in a wellbore.

4. The assembly of claim 1, wherein the reactive layer comprises nickel or boron.

5. The assembly of claim 1, wherein the explosive device is thermally coupled to the solid-state overvoltage firing switch to enable the explosive device to detonate in response to the thermal energy.

6. The assembly of claim 1, further comprising a plurality of reactive sets, wherein each reactive set comprises an oxidant material coupled to a reactive material, and wherein the plurality of reactive sets are operable to generate additional thermal energy responsive to the reactive layer chemically reacting with the conductive anode or the conductive cathode.

7. The assembly of claim 1, wherein a part of the insulator layer is uncovered by the reactive layer.

8. The assembly of claim 1, wherein the explosive device is a perforating gun usable in a wellbore.

9. An assembly comprising:

a solid-state overvoltage firing switch operable to control an explosive device, the solid- state overvoltage firing switch comprising:

a substrate layer;

a conductive anode and a conductive cathode, the conductive anode and the conductive cathode being positioned on the substrate layer, wherein a gap physically separates the conductive anode from the conductive cathode, wherein the conductive anode is operable to receive a voltage from a power source;

an insulator layer adjacent to the conductive anode and the conductive cathode, at least part of the insulator layer filling the gap, wherein the insulator layer is operable to cover a first portion of the conductive anode and a second portion of the conductive cathode; and a protective layer configured to protect the solid-state overvoltage firing switch from damage.

10. The assembly of claim 9, wherein a part of the insulator layer is uncovered by the protective layer.

11. An assembly comprising:

a solid-state overvoltage firing switch operable to control an explosive device, the solid-state overvoltage firing switch comprising:

a substrate layer;

a conductive anode and a conductive cathode, the conductive anode and the conductive cathode being positioned on the substrate layer, wherein a gap physically separates the conductive anode from the conductive cathode, wherein the conductive anode is operable to receive a voltage from a power source;

an insulator layer adjacent to the conductive anode and the conductive cathode, at least part of the insulator layer filling the gap, wherein the insulator layer is operable to cover a first portion of the conductive anode and a second portion of the conductive cathode, a first via extending through the substrate layer and coupled to the conductive anode; and a second via extending through the substrate layer and coupled to the conductive cathode, wherein the first via and the second via comprise gold, copper, or aluminum, and wherein the first via and the second via are operable to electrically couple the solid-state overvoltage firing switch to a printed circuit board.

12. An assembly comprising:

a solid-state overvoltage firing switch operable to control an explosive device, the solid-state overvoltage firing switch comprising:

a substrate layer;

a conductive anode and a conductive cathode, the conductive anode and the conductive cathode being positioned on the substrate layer, wherein a gap physically separates the conductive anode from the conductive cathode, wherein the conductive anode is operable to receive a voltage from a power source; and an insulator layer adjacent to the conductive anode and the conductive cathode, at least part of the insulator layer filling the gap, wherein the insulator layer is operable to cover a first portion of the conductive anode and a second portion of the conductive cathode, wherein a first part of the conductive anode is uncovered by the insulator layer and a second part of the conductive cathode is uncovered by the insulator layer, and wherein the first part is coupled to a wire in an electrical circuit and the second part is coupled to another wire in the electrical circuit.

13. A method comprising:

receiving a first voltage from a power source by a solid-state overvoltage firing switch, the solid-state overvoltage firing switch comprising:

a conductive anode coupled to a substrate, a conductive cathode coupled to the substrate and positioned to generate a gap between the conductive anode and the conductive anode, an insulator layer adjacent to the conductive anode and the conductive cathode, at least part of the insulator layer filling the gap, and a reactive layer;

in response to receiving the first voltage, electrically breaking down the insulator layer;

in response to the insulator layer electrically breaking down, generating a first chemical reaction between the reactive layer and the conductive anode or the conductive cathode; and in response to generating the first chemical reaction, emitting thermal energy from the solid-state overvoltage firing switch for detonating an explosive device.

14. The method of claim 13, wherein the solid-state overvoltage firing switch is in a well system and controls the explosive device.

15. The method of claim 13, wherein the reactive layer comprises nickel or boron.

16. The method of claim 13, further comprising:

responsive to generating the first chemical reaction, generating a second chemical reaction between a reactive material coupled to an oxidant layer positioned on the reactive layer; and responsive to generating the second chemical reaction, emitting additional thermal energy from the solid-state overvoltage firing switch, wherein the additional thermal energy at least partially causes the explosive device to detonate.

17. A system comprising:

a solid-state overvoltage firing switch operable to control an explosive device, the solid-state overvoltage firing switch comprising:

a substrate layer;

a conductive anode and a conductive cathode positioned on the substrate layer;

a gap physically separating the conductive anode from the conductive cathode;

an insulator layer adjacent to the conductive anode, the conductive cathode, and the gap, wherein at least part of the insulator layer fills the gap; and a reactive layer coupled to the insulator layer, wherein the reactive layer is operable to chemically react with the conductive anode or the conductive cathode to generate thermal energy;

the explosive device, wherein the explosive device is thermally coupled to the solid-state overvoltage firing switch and is positionable in a wellbore; and a power source electrically coupled to the explosive device and the solid-state overvoltage firing switch, wherein the power source is operable to transmit a voltage to the conductive anode.

18. The system of claim 17, wherein the reactive layer comprises nickel or boron.

19. The system of claim 17, wherein the explosive device is configured to detonate in response to the thermal energy from the solid-state overvoltage firing switch.

20. The system of claim 17, wherein the explosive device is included in a perforating gun usable in the wellbore.

21. The assembly of claim 9, wherein the current is operable to detonate the explosive device, and wherein the explosive device is positioned in a wellbore.

22. The assembly of claim 9, wherein the explosive device is a perforating gun usable in a wellbore.

23. The assembly of claim 11, wherein the current is operable to detonate the explosive device, and wherein the explosive device is positioned in a wellbore.

24. The assembly of claim 11, wherein the explosive device is a perforating gun usable in a wellbore.

25. The assembly of claim 12, wherein the current is operable to detonate the explosive device, and wherein the explosive device is positioned in a wellbore.

26. The assembly of claim 12, wherein the explosive device is a perforating gun usable in a wellbore.

* * * * *